US011363881B1

(12) United States Patent
De Mesa

(10) Patent No.: US 11,363,881 B1
(45) Date of Patent: Jun. 21, 2022

(54) TOOTHBRUSH WITH CONTOURED NECK AND BACK FIN

(71) Applicant: Yvonne De Mesa, Pleasanton, CA (US)

(72) Inventor: Yvonne De Mesa, Pleasanton, CA (US)

( * ) Notice: Subject to any disclaimer, the term of this patent is extended or adjusted under 35 U.S.C. 154(b) by 131 days.

(21) Appl. No.: 16/543,602

(22) Filed: Aug. 18, 2019

Related U.S. Application Data

(60) Provisional application No. 62/766,674, filed on Oct. 31, 2018.

(51) Int. Cl.

| | |
|---|---|
| ***A46B 15/00*** | (2006.01) |
| ***A46B 9/04*** | (2006.01) |
| *A46B 5/00* | (2006.01) |
| *A46D 3/00* | (2006.01) |

(52) U.S. Cl.
CPC ..... *A46B 15/0081* (2013.01); *A46B 9/04* (2013.01); *A46B 5/00* (2013.01); *A46B 15/00* (2013.01); *A46B 2200/1066* (2013.01); *A46D 3/00* (2013.01)

(58) Field of Classification Search
CPC ... A46B 9/04; A46B 15/0075; A46B 15/0055; A46B 15/0081; A61H 13/00; A61H 17/244; A61C 17/3481
USPC ..... 601/141
See application file for complete search history.

(56) References Cited

U.S. PATENT DOCUMENTS

| | | | | |
|---|---|---|---|---|
| 3,196,299 A * | 7/1965 | Kott | A61C 17/3481 | 310/81 |
| 3,474,481 A * | 10/1969 | Schiff | A46B 9/04 | 15/167.1 |
| 7,073,225 B1 * | 7/2006 | Ford | A46B 7/04 | 132/310 |
| 8,240,936 B2 * | 8/2012 | Vazquez | A46B 15/0055 | 401/184 |
| 9,161,613 B1 * | 10/2015 | Chirichiello | A46B 9/04 | |

FOREIGN PATENT DOCUMENTS

| | | | |
|---|---|---|---|
| DE | 19857011 A1 * | 6/2000 | A46B 15/00 |
| DE | 102004013892 A1 * | 10/2005 | A61C 17/00 |
| GB | 2451230 A * | 1/2009 | A46B 15/00 |

OTHER PUBLICATIONS

English translation of DE 102004013892 A1, Backhaus, Marc, Oct. 2005. (Year: 2005).*

(Continued)

*Primary Examiner* — Laura C Guidotti
(74) *Attorney, Agent, or Firm* — Adibi IP Group, PC; Amir V. Adibi; Andrew C. Palmer

(57) ABSTRACT

A fin toothbrush includes a contoured neck and a back fin. The back fin moves soft tissue, such as the cheek or tongue of a user's mouth, thereby providing greater access to teeth when brushing. In one embodiment, the back fin is located at the back of the brush head and neck and extends in a direction that is opposite of the bristles. The back fin also has an elongated curved shape so as to provide a smooth surface to the tongue and soft tissues when brushing. When the toothbrush is positioned to brush the back teeth, the back fin pushes the cheek away from the teeth, thereby allowing the teeth to be easily cleaned. The toothbrush also includes a contoured neck, which provides space and relief to prevent the neck of the toothbrush from rubbing against soft tissues.

17 Claims, 6 Drawing Sheets

(56) References Cited

OTHER PUBLICATIONS

"History of Toothbrushes and Toothpastes", https://www.colgate.com/en-us/oral-health/basics/brushing-and-flossing/history-of-toothbrushes-and-toothpastes, downloaded on Aug. 18, 2019 (4 pages).

*Oral Health and Care in the Intensive Care Unit: State of the Science*, Munro and Grap, American Journal of Critical Care, Jan. 2004, vol. 13, No. 1, 2004 (11 pages).

"Toothbrush", Wikipedia, https://en.wikipedia.org/wiki/Toothbrush, downloaded Aug. 18, 2019 (9 pages).

"Where in the mouth do cavities often develop?", https://www.sharecare.com/health/cavities/mouth-do-cavities-often-develop, downloaded Aug. 18, 2019 (5 pages).

* cited by examiner

PROVIDING A TOOTHBRUSH

FORMING A TOOTHBRUSH

TOOTHBRUSH WITH CONTOURED NECK AND BACK FIN

CROSS-REFERENCE TO RELATED APPLICATIONS

This application claims the benefit under 35 U.S.C. § 119 of U.S. Provisional Application No. 62/766,674, filed on Oct. 31, 2018, and entitled "Fin Tooth Brush," which is hereby incorporated by reference in its entirety.

TECHNICAL FIELD

The present invention relates generally to dental equipment, and more particularly, to a toothbrush having a contoured neck and back fin that enhances brushing ease and efficacy.

BACKGROUND INFORMATION

A toothbrush is a basic instrument used by virtually all people on a daily basis. Typically, a toothbrush is used to clean the teeth, gums, and tongue to maintain oral health. Oral health is largely impacted by dental plaque that gives micro-organisms a natural surrounding or habitat where they can survive, and it also opens the door for micro-organisms to adhere to either the surface of the teeth or to other organisms. The utilization of a toothbrush combined with dentifrices are the most well-known techniques for cleaning the teeth in an effort to expel plaques.

A typical toothbrush comprises a head of firmly grouped bristles for brushing, and a handle for a user to hold and manipulate while brushing. Toothpaste or other cleaning agent may also be used to assist in cleaning the teeth.

Unfortunately, conventional toothbrushes are not designed to provide the most efficient and thorough cleaning for every user. For example, the configuration of the head, bristles, and handle may not be suitable to thoroughly clean the teeth of every user. The shape of the mouth, size of the jaw, orientation of the teeth, and other characteristics are different from person to person. Thus, a particular toothbrush configuration may work well for some people but not for others.

Therefore, it would be desirable to have a toothbrush configured to enhance brushing ease and efficacy.

SUMMARY

In various embodiments, a toothbrush having a contoured neck and back fin is disclosed. The back fin moves soft tissue, such as the cheek or tongue of a user's mouth, to provide greater access to teeth when brushing. In one embodiment, the back fin is located at the back of the brush head and neck and extends in a direction that is opposite of the bristles. The back fin also has an elongated curved shape so as to provide a smooth surface to the tongue and soft tissues when brushing. When the toothbrush is positioned to brush the back teeth, the back fin pushes the cheek away from the teeth, thereby allowing the teeth to be easily cleaned. The toothbrush also includes a contoured neck, which provides space and relief to prevent the neck of the toothbrush from rubbing against soft tissues.

In another embodiment, an apparatus is provided that includes a handle, a brush head having bristles extending from a first side, a neck that connects the handle to the brush head, and a back fin located on a second side of the brush head that is opposite of the first side.

In yet another embodiment, an apparatus is provided that includes a handle and a brush head having bristles extending from a first side. The apparatus also comprises means for connecting the handle to the brush head and means for soft tissue displacement extending from a second side of the brush head that is opposite of the first side.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. 2 shows an embodiment of the toothbrush having a fin as shown in FIG. 1.

DETAILED DESCRIPTION

In various embodiments, a toothbrush having a back fin is provided that enhances the ease and efficiency of brushing teeth. In one embodiment, the back fin comprises an elongated protrusion located on the back of the brush head that has a smooth surface. During use, the back fin displaces soft tissues inside the mouth of a user, thereby providing greater access to back teeth and making brushing easier and more effective.

Figure 1:
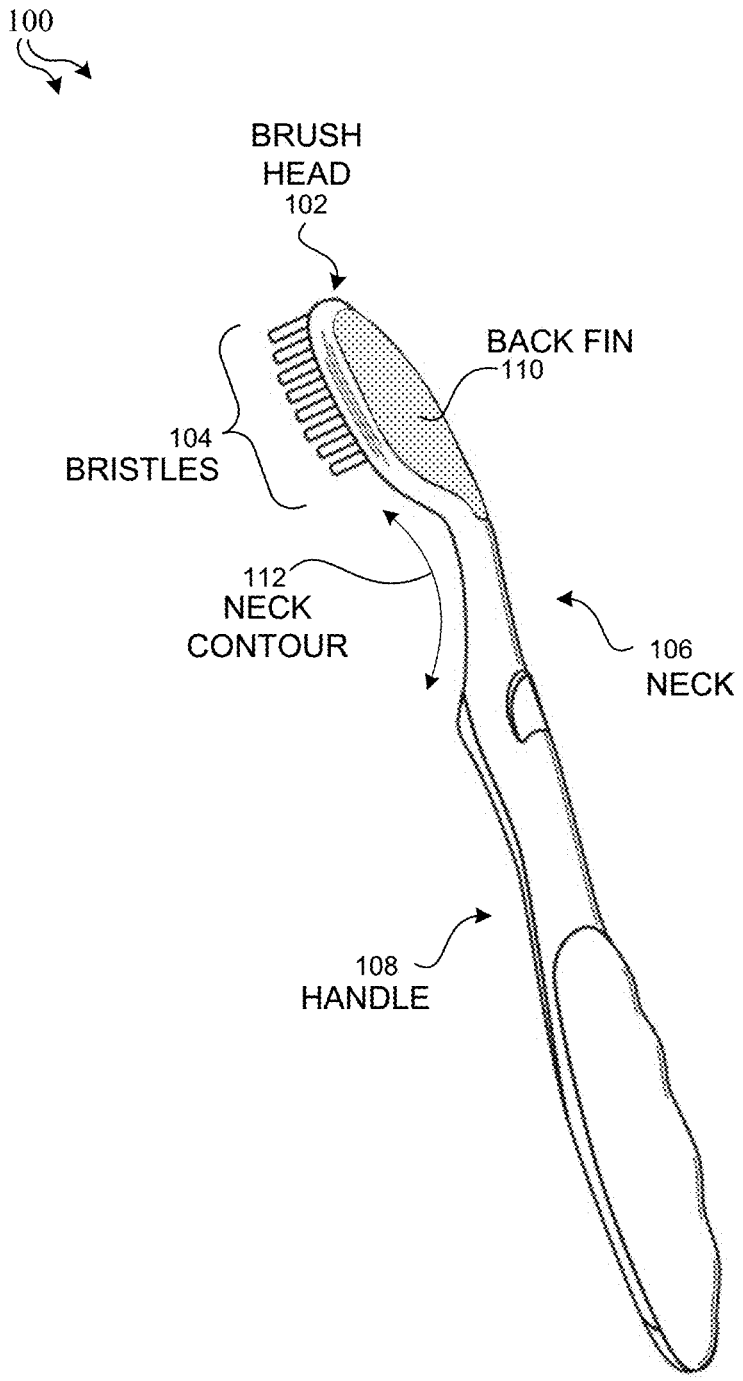
FIG. 1 shows a perspective view of an embodiment of a toothbrush having a back fin.

FIG. 1 shows a perspective view of an embodiment of a toothbrush 100 having a back fin 110. The toothbrush 100 comprises a brush head 102, bristles 104, neck 106, and handle 108. The toothbrush 100 also comprises the back fin 110 that is located on a back portion of the brush head 102. During brushing, the back fin 110 displaces soft tissues inside the mouth of a user, thereby making brushing easier and more effective. In various embodiments, the back fin 110 can also be referred to as a hump, bump, humpback, hunchback, scale, wing, crest, ridge, caruncle, dorsal appendage, or any other name for a protuberance (protrusion). The material of the back fin 110 comprises plastic, recycled plastic, dense silicon, rubber, metal, composite material, and even colorful or gelatin-like substances in which sparkly animal shaped features can be embedded inside to attract children. In various embodiments, the back fin 110 can be formed from virtually any material that is suitable for use in the mouth. In various embodiments, the back fin 110 can be configured to be solid, a hollow frame, molded, liquid filled, or some other structure or configuration.

In one embodiment, the dimensions for the back fin 110 are configurable to cover all sizes appropriate for all different age groups. A major purpose of the back fin 110 is to maximize the effectiveness of brushing (removing plaque) by retracting soft tissues, even in hard-to-reach areas. The back fin 110 retracts cheek, tongue, and soft tissues. It moves them away from the outer, inner, and masticatory surfaces of the teeth, especially the upper and lower teeth at the very back.

In addition to the back fin 110, the neck 106 provides a neck contour 112 that protects teeth from improper strikes of bristles, since this curvature follows the natural curve of the jaw. The neck contour 112 also provides space or relief to prevent the toothbrush from rubbing against soft tissues.

A length of the back fin 110 varies across different embodiments. In one embodiment, the back fin 110 extends downwards towards the handle 108 such that part of the back fin 110 extends below the head 102 and the bristles 104. In another embodiment, the back fin 110 extends downwards towards the handle 108 such that the back fin 110 is level with the head 102 and the bristles 104. In yet another embodiment, the back fin 110 extends downwards towards the handle 108 such that the back fin 110 does not extend below the head 102 or the bristles 104.

Figure 2:
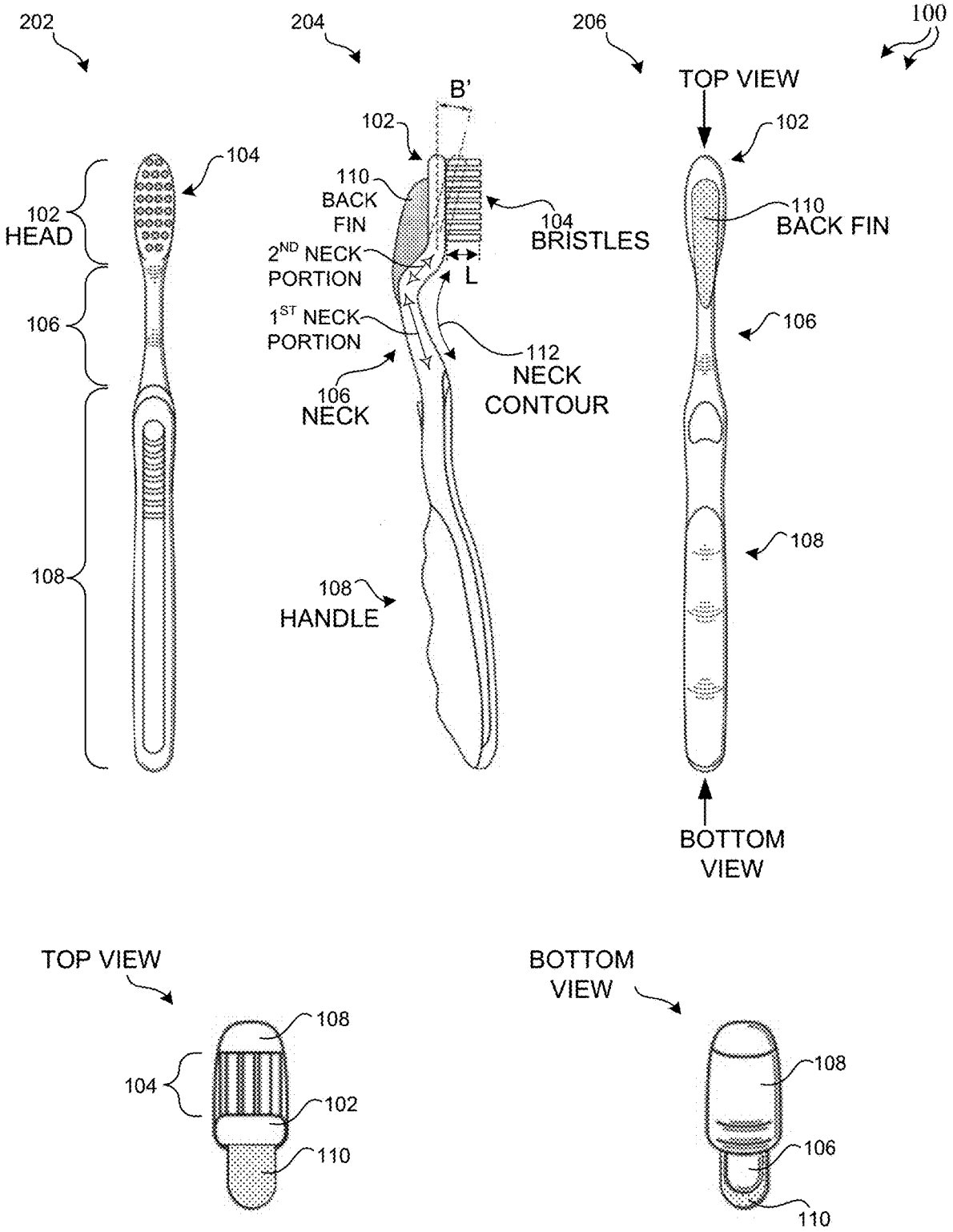
FIG. 2 shows multiple views of the toothbrush shown in FIG. 1.

FIG. 2 shows multiple views of the toothbrush 100 shown in FIG. 1. A front view 202 shows the brush head 102, bristles 104, neck 106, and handle 108. In an embodiment, the bristles have a 0.01 millimeter (mm) diameter and 1.5 mm spacing between tufts and are suitable to brush gums and tongue because of their fine texture. The fine bristles also distribute force equally across the surface of the teeth to prevent oral hard and soft tissue damage or wear.

A side view 204 shows the brush head 102, bristles 104, neck 106, and handle 108. In one embodiment, the brush head 102 has an incline angle B' in the range of five degrees (5°). In an embodiment, the bristles 104 have a length (L) of 11 mm. The side view 204 also shows the back fin 110 and illustrates the neck contour 112. For example, the neck 106 comprises a first neck portion and a second neck portion that form the neck contour 112. The neck contour 112 forms a notch that provides space or relief to prevent the toothbrush from rubbing against the lips or soft tissue.

A back view 206 shows the brush head 102, neck 106, handle 108 and back fin 110. The back view 206 also indicates the directions of a top view and a bottom view.

The top view is shown in detail and illustrates the brush head 102, bristles 104, handle 108, and back fin 110. The bottom view is shown in detail and illustrates the handle 108, neck 106, and back fin 110.

Figure 3:
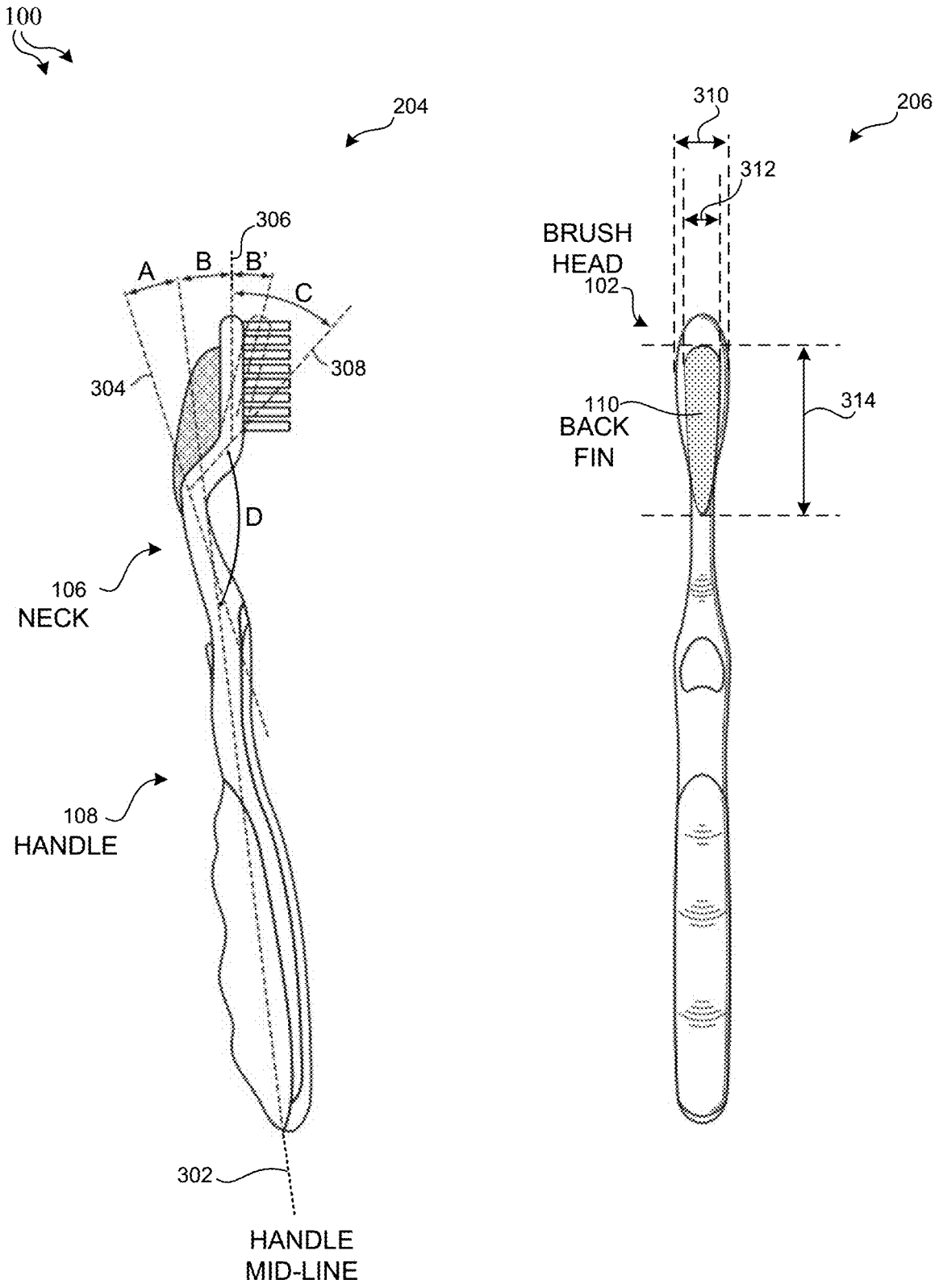
FIG. 3 shows two views of the toothbrush 100 shown in FIG. 2.

FIG. 3 shows two views of the toothbrush 100 that are also shown in FIG. 2. The side view 204 illustrates multiple angle indicators that describe angles and orientation of the components of the toothbrush 100. The toothbrush 100 has multiple angles related to the head 102 and neck 106 components in addition to a straight handle 108 that requires less dexterity than conventional toothbrushes to remove plaque from all surfaces.

In one embodiment, a handle mid-line 302 is defined that flows through the middle of the handle 108. A first neck mid-line line 304 is defined that flows through a first bend portion of the neck 106. A second neck mid-line line 308 is defined that flows through a second bend portion of the neck 106. A brush head mid-line 306 is defined that flows through the brush head 102.

In one embodiment, the angle A between the handle mid-line 302 and the first neck portion mid-line 304 is within a range of five to ten degrees (5°-10°). The angle B between the handle mid-line 302 and the brush head mid-line 306 is approximately fifteen degrees (15°), which is matched to the curvature of the teeth arch. In another embodiment, the brush head 102 is provided with additional incline relative to the handle mid-line 302. For example, the angle B' illustrates that the incline of the brush head 102 relative to the handle mid-line 302 may be increased up to an additional five degrees (5°). Thus, the angles B and B' show that the angle between the handle mid-line 302 and the brush head mid-line 306 can be in the range of fifteen to twenty degrees (15°-20°).

The angle C between the brush head mid-line 306 and the second neck portion mid-line 308 is within a range of thirty to thirty-five degrees (30°-35°) due to the variation in the incline of the brush head. The angle D between the handle mid-line 302 and the second neck portion mid-line 308 forms a notch or indentation and is one-hundred and thirty degrees (130°). This notch provides more convenient access to the teeth since it is designed to relive the lip and provide access to the lower part of the mouth. In other embodiments, the angle D extends between ninety degrees (90°) and one-hundred and eighty degrees (180°). In yet other embodiments, there is no notch or indentation.

The back view 206 illustrates multiple dimensions associated with the back fin 110 and brush head 102. In one embodiment, the brush head 102 has a width 310 that is within the range of 10 mm. The back fin 110 has a width 312 that is within the range of 3-5 mm. The back fin 110 also has a length 314 that is within the range of 50 mm. In an embodiment, the back fin 110 is tapered so that it is at is widest near the top of the brush head 102 and at its narrowest near the handle 108.

Figure 4:
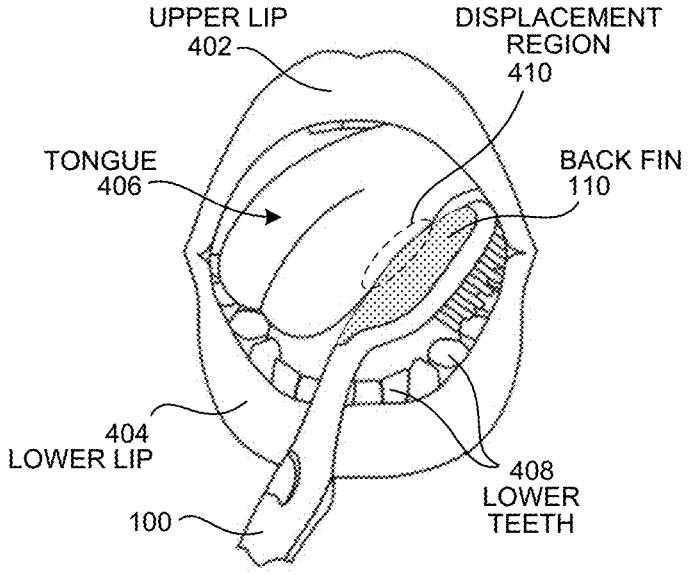
FIG. 4 illustrates the operation of the toothbrush with back fin to displace the tongue to facilitate brushing the inside surfaces of the teeth.

FIG. 4 illustrates the operation of the toothbrush 100 with back fin 110 to displace the tongue to facilitate brushing inside surfaces of the teeth. As shown FIG. 4, an open mouth having upper lip 402, lower lip 404, tongue 406 and lower teeth 408 is shown. The toothbrush 100 is also shown and its use to brush inside surfaces of the lower teeth 408 is illustrated. During this operation, the back fin 110 operates to displace the tongue 406, as shown in the displacement region 410, to facilitate brushing of the inside surfaces of the teeth. The back fin 110 operates to displace the tongue when brushing any of the inside surfaces of the lower teeth.

Figure 5:
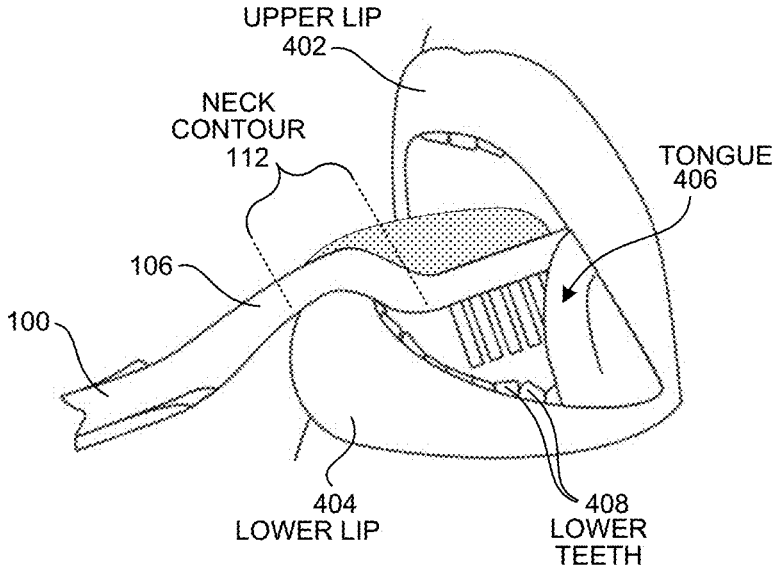
FIG. 5 illustrates the operation of the toothbrush with back fin and contoured neck to facilitate brushing surfaces of the teeth.

FIG. 5 illustrates the operation of the toothbrush 100 with back fin 110 and neck 106 to facilitate brushing surfaces of the teeth. As shown FIG. 5, an open mouth having upper lip 402, lower lip 404, tongue 406, and lower teeth 408 is shown. The toothbrush 100 is also shown and its use to brush inside surfaces of the lower teeth 408 is illustrated. During this operation, the notch formed by the neck contour 112 provides a space around the lower lip 404 to facilitate brushing the surfaces of the teeth. The neck contour 112 provides a space around both the upper 402 and lower 404 lips to facilitate brushing the upper and lower teeth, respectively.

Figure 6:
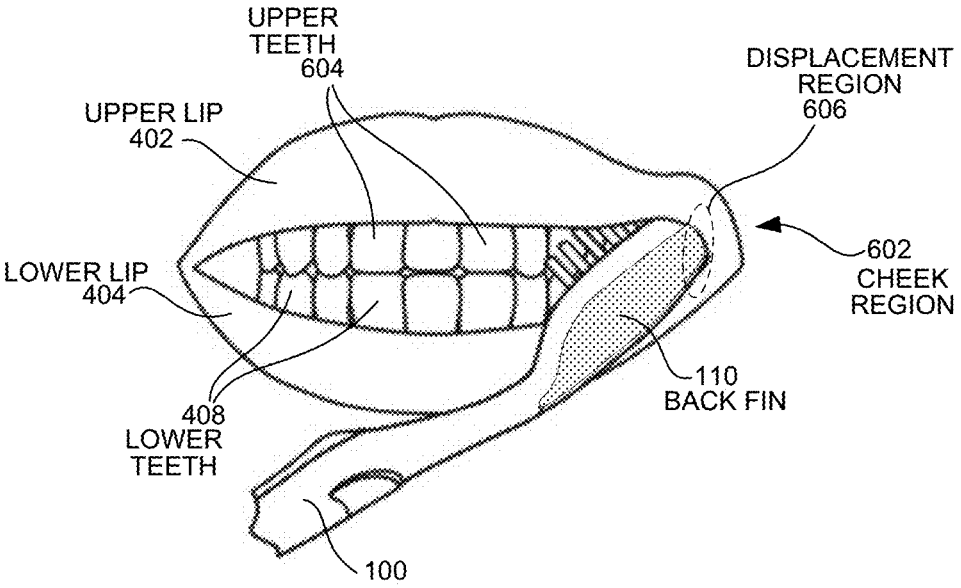
FIG. 6 illustrates the operation of the toothbrush with back fin to displace the cheek and soft tissues around the mouth to facilitate brushing outside surfaces of the teeth.

FIG. 6 illustrates the operation of the toothbrush 100 with back fin 110 to displace the cheek and soft tissues around the mouth to facilitate brushing outside surfaces of the teeth. As shown FIG. 6, an open mouth having upper lip 402, lower lip 404, upper teeth 604, lower teeth 408, and cheek region 602 is shown. The toothbrush 100 is also shown and its use to brush outside surfaces of the lower 408 and upper 604 teeth is illustrated. During this operation, the back fin 110 operates to displace the cheek region 602, as shown in the displacement region 606, to facilitate brushing of the outside surfaces of the teeth.

Figure 7:
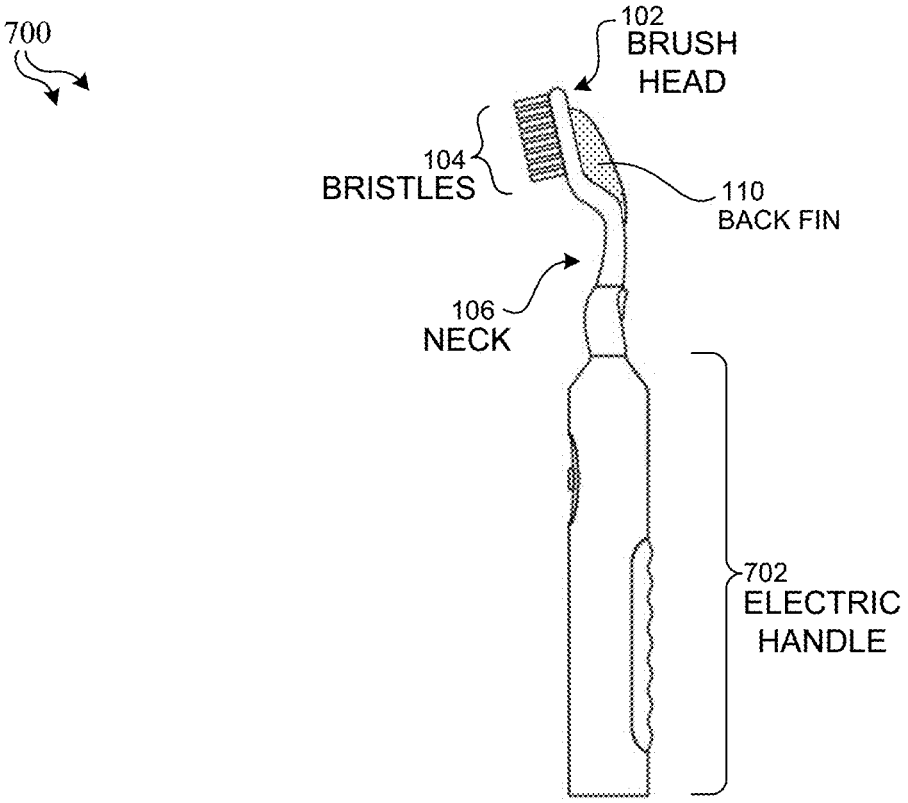
FIG. 7 shows an alternative embodiment of a toothbrush having a back fin.

FIG. 7 shows an alternative embodiment of a toothbrush 700 having a back fin 110. The toothbrush 700 comprises a brush head 102, bristles 104, and neck 106 that are the same as the toothbrush 100 described with reference to FIG. 1. The handle 108 shown in FIG. 1 is replaced with an electric handle 702. Thus, the toothbrush 700 provides all the features and advantages of the toothbrush 100 but includes an electric handle 702 that provides automated oscillation and/or vibrating operation to brush the teeth.

Figure 8:
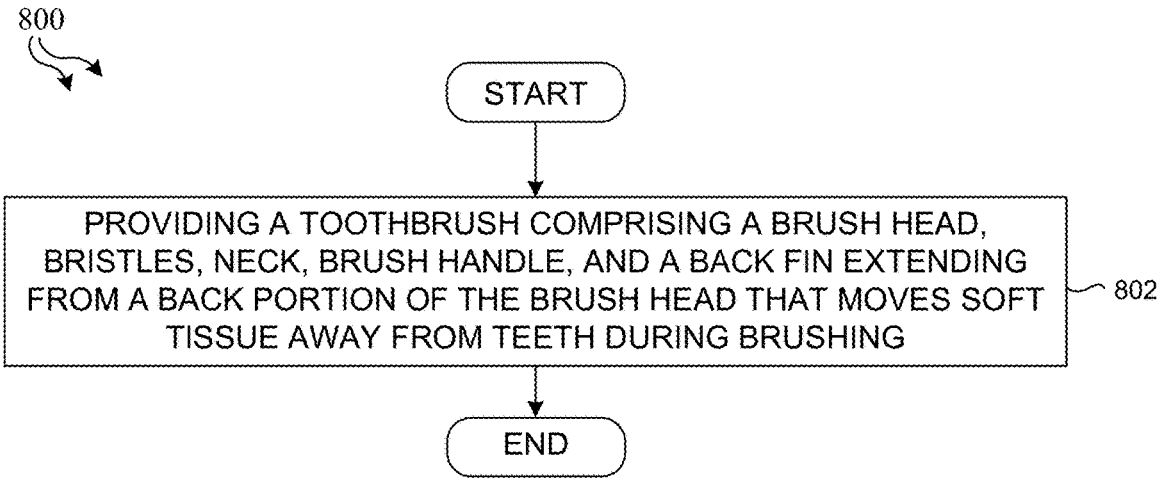
FIG. 8 shows a method for providing a toothbrush having a back fin that facilitates tooth brushing.

FIG. 8 shows a method 800 for providing a toothbrush having a back fin that facilitates tooth brushing. The method 800 comprises an operation (802) of providing a toothbrush comprising a brush head, bristles, neck, brush handle, and a back fin extending from a back portion of the brush head that moves soft tissue away from teeth during brushing.

Figure 9:
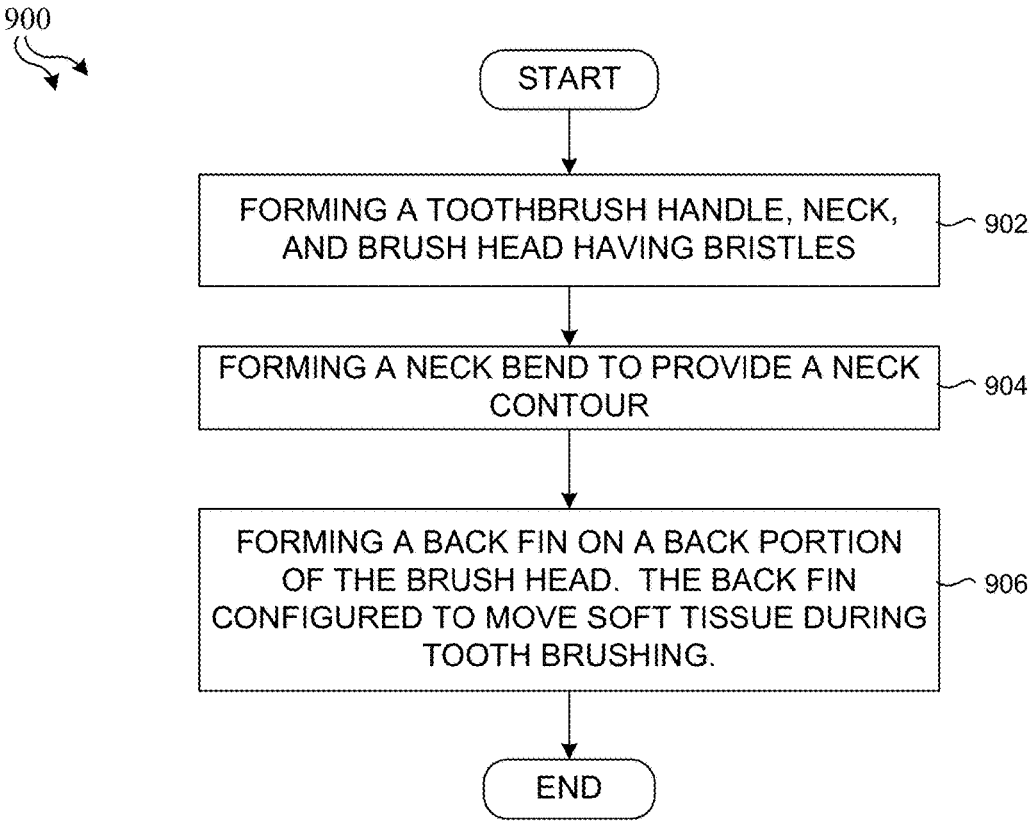
FIG. 9 shows a method for forming a toothbrush having a back fin that facilitates tooth brushing.

FIG. 9 shows a method 900 for forming a toothbrush having a back fin that facilitates tooth brushing. The method 900 comprises an operation (902) of forming a toothbrush handle, neck, and brush head having bristles. The method 900 also comprises an operation (904) of forming a neck bend to provide a neck contour. The method 900 also comprises an operation (906) of forming a back fin on a back portion of the brush head. The back fin configured to move soft tissue during tooth brushing.

Although certain specific embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. An apparatus, comprising:
a handle;
a brush head having bristles extending from a first side;
a neck that connects the handle to the brush head, wherein the neck has a bend forming angled first and second neck portions; and
a back fin located on a second side of the brush head that is opposite the first side, wherein a width of the back fin is tapered so that it is widest near a top of the brush head and narrowest near the handle, and wherein the back fin extends from the top of the brush and beyond the bend of the neck towards the handle.

2. The apparatus of claim 1, wherein the neck includes a neck contour that forms a notch.

3. The apparatus of claim 1, wherein the back fin is solid.

4. The apparatus of claim 1, wherein the back fin is a hollow frame.

5. The apparatus of claim 1, wherein the back fin comprises material selected from a set comprising plastic, rubber, silicone, metal, and composite materials.

6. The apparatus of claim 1, wherein an angle between the handle and the first neck portion is in a range of five degrees to ten degrees (5°-10°), and wherein an angle between the handle and the second neck portion is one-hundred and thirty degrees (130°).

7. The apparatus of claim 1, wherein the brush head and handle form an angle in the range of fifteen degrees to twenty degrees (15°-20°).

8. The apparatus of claim 1, wherein the handle comprises a solid handle.

9. The apparatus of claim 1, wherein the handle comprises a battery-operated handle that provides oscillation or vibration to the brush head.

10. An apparatus, comprising:
a neck that connects a handle to a brush head, wherein the brush head has bristles extending from a first side, and wherein the neck has a bend forming angled first and second neck portions; and
means for soft tissue displacement extending from a second side of the brush head that is opposite of the first side, wherein the means for soft tissue displacement extends from a top of the brush head and beyond the bend of the neck towards the handle, and wherein a width of the means for soft tissue displacement is tapered so that it is widest near a top of the brush head and narrowest near the handle.

11. The apparatus of claim 10, wherein the neck provides a notch.

12. The apparatus of claim 10, wherein the means for soft tissue displacement is solid.

13. The apparatus of claim 10, wherein the means for soft tissue displacement is a hollow frame.

14. The apparatus of claim 10, wherein the means for soft tissue displacement comprises material selected from a set comprising plastic, rubber, silicone, metal, and composite materials.

15. A toothbrush product formed by performing operations comprising:
forming a handle, neck, and brush head having bristles, wherein the neck has a bend forming angled first and second neck portions; and
forming a back fin extending from a back portion of the brush head and extending from a top of the brush head and beyond the bend of the neck towards the handle, wherein the back fin is formed to move soft tissue away from teeth during brushing, and wherein a width of the back fin is tapered so that it is widest near a top of the brush head and narrowest near the handle.

16. The product of claim 15, wherein the neck provides a notch that prevents the neck from rubbing on lips or soft tissue when brushing.

17. The product of claim 15, wherein the operation of forming the back fin comprises forming the back fin to have a structure comprising at least one of solid, hollow, and liquid-filled structures, and wherein the structure is formed from at least one material selected from a group consisting of plastic, rubber, silicone, metal, and composite materials.

* * * * *